US006223399B1

(12) United States Patent
Chen

(10) Patent No.: US 6,223,399 B1
(45) Date of Patent: May 1, 2001

(54) ADORNMENT CLAMPING DEVICE

(76) Inventor: Teng-Kuei Chen, 11 Fl., No. 63, Lane 122, Sec. 4, Jen-Ai Rd., Taipei (TW)

( * ) Notice: Subject to any disclaimer, the term of this patent is extended or adjusted under 35 U.S.C. 154(b) by 0 days.

(21) Appl. No.: 09/372,864

(22) Filed: Aug. 12, 1999

(51) Int. Cl.[7] ..... A44B 21/00; A44C 3/00; A45F 5/08

(52) U.S. Cl. ..... 24/3.1; 24/3.6; 24/3.12

(58) Field of Search ..... 24/3.1, 3.12, 6, 24/13; 40/1.5, 641

(56) References Cited

U.S. PATENT DOCUMENTS 333,590 * 1/1886 Benson ..... 24/6
4,559,675 * 12/1985 Devenny ..... 24/6
4,605,335 * 8/1986 Otrusina ..... 24/3.12
5,640,742 * 6/1997 White et al. ..... 24/3.12

* cited by examiner

*Primary Examiner*—Victor N. Sakran
(74) *Attorney, Agent, or Firm*—William E. Pelton, Esq.

(57) ABSTRACT

The present invention relates to an adornment clamping device which is able to secure the adornment to the base of an item. The device has an elongate bar securely connected with the base by means of a neck, an adornment having a through hole defined to allow the elongate bar to be inserted therethrough and having a press fit therewith and a slit defined to communicate with the through hole, such that when the elongate bar extends through the through hole of the adornment, the adornment is able to be secured by the press fit between the protrusion formed on the neck and the slit.

5 Claims, 8 Drawing Sheets

ADORNMENT CLAMPING DEVICE

BACKGROUND OF THE INVENTION

1. Field of the Invention

The present invention relates to a adornment clamping device, and more particularly to an adornment clamping device having an elongate bar, a neck portion connected between an object and the elongate bar and a through hole defined in the adornment with a slit communicating with the through hole. The elongate bar is able to be inserted through the through hole and because of the slit, the elongate bar is able to have a press fit with the adornment.

2. Description of the Related Art

Conventional adornment may be used on the barrette, brooch, the pen carriage, the book carriage and so on, in order to increase the attraction to the customers. However, because most of the adornment are adhered to an item with adhesive, they are quite difficult to take it off once the adornment is securely attached to the item. Under such a circumstance, users will almost have no chance to change the adornment to go with the clothes or any other personal accessories. To overcome the shortcoming, a new method of clamping the adornment to the base of the item is developed, which uses a post extending outward from the base so as to be inserted through a hole defined in the adornment. By means of the connection between the post and the hole, the adornment is able to be secured on the item and the user is able to change the adornment whenever is necessary. Although the post-hole connection between the adornment and the item enables the user to change whatever he/she likes, this simple connection between the adornment and the item is loose and the adornment is quite easy to detach from the item so that a need to improve the connection between the adornment and the item is necessary.

It is an objective of the invention to provide an improved adornment clamping device to obviate and/or mitigate the aforementioned problems.

SUMMARY OF THE INVENTION

The main object of the present invention is to provide an adornment clamping device having an elongate bar extending from the face of an item and a through hole defined in the adornment. By means of the connection between the elongate bar and the through hole, the adornment is able to securely attach to the item.

Another objective of the invention is to provide an adornment having a through hole and a slit defined to communicate with the through hole, such that the elongate bar is able to have a press fit with the adornment.

Other objects, advantages and novel features of the invention will become more apparent from the following detailed description when taken in conjunction with the accompanying drawings.

DETAILED DESCRIPTION OF THE PREFERRED EMBODIMENT

Figure 1:
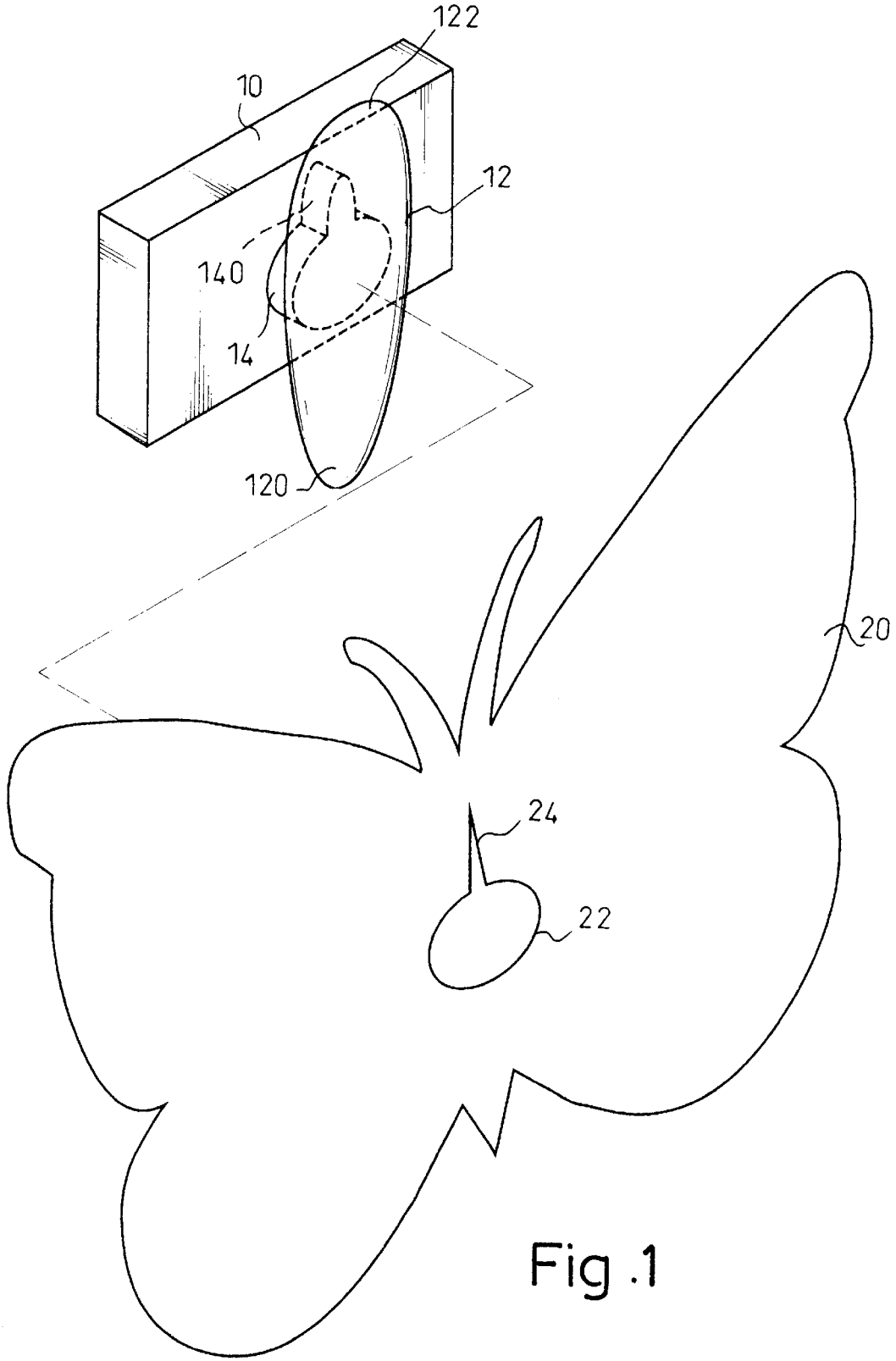
FIG. 1 is an exploded perspective view of a preferred embodiment in accordance with the present invention.

Referring to FIG. 1, the adornment clamping device constructed in accordance with the preferred embodiment of the invention has a base (10) and an adornment (20) detachably connected with the base (10). The base (10) has an elongate bar (12) and a neck (14) integrally formed between the base (10) and the elongate bar (12). The elongate bar (12) is shaped to be an oval. Therefore, the elongate bar (12) has a first end (120) and a second end (122). The neck (14) has a protrusion (140) integrally extending in a direction of the second end (122) of the elongate bar (12). The adornment (20) has a through hole (22) and a slit (24) defined to communicate with the through hole (22).

Figure 2:
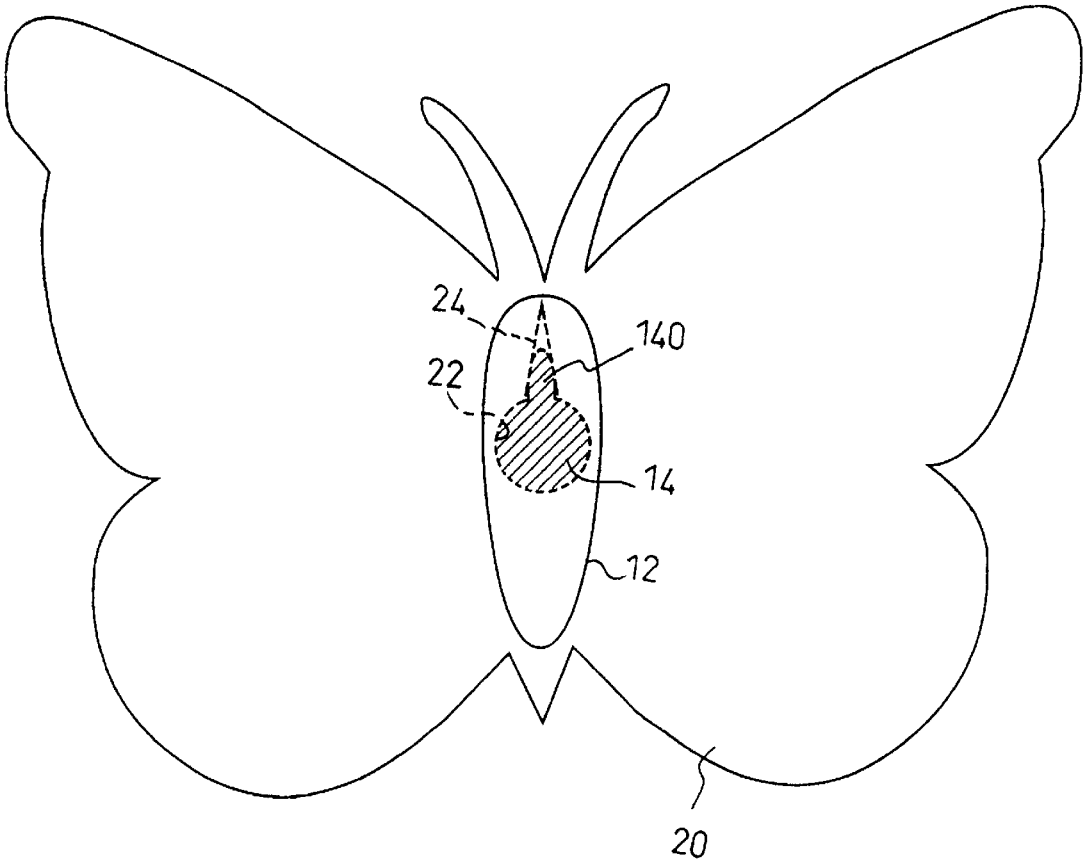
FIG. 2 is a plan view of a preferred embodiment in accordance with the present invention, wherein the elongate bar of a base extends through the through hole of the adornment to attach to the adornment.
Figure 3:
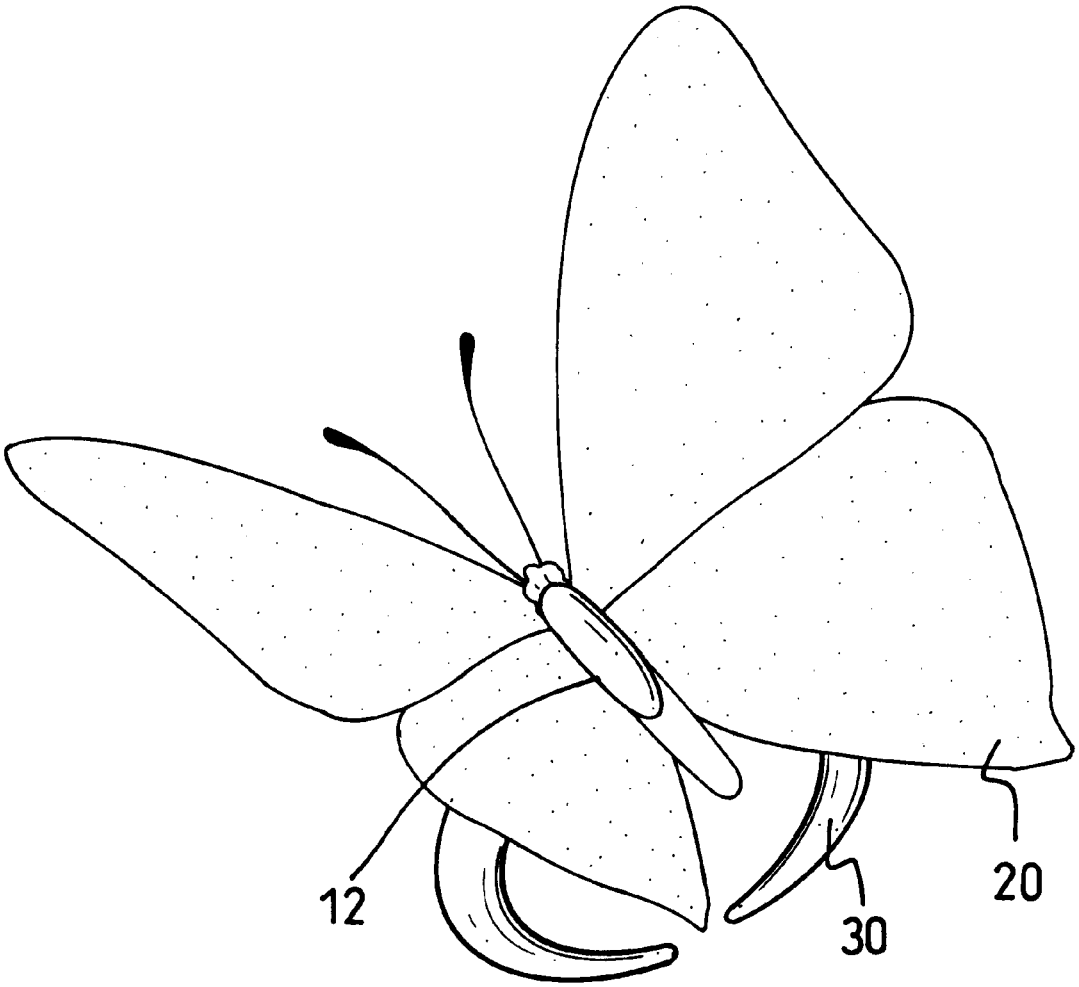
FIG. 3 to FIG. 6 are perspective views of the preferred embodiments in accordance with the present invention, wherein the bases are shown in different shapes to show that the adornment is able to be attached to any suitable items.
Figure 4:
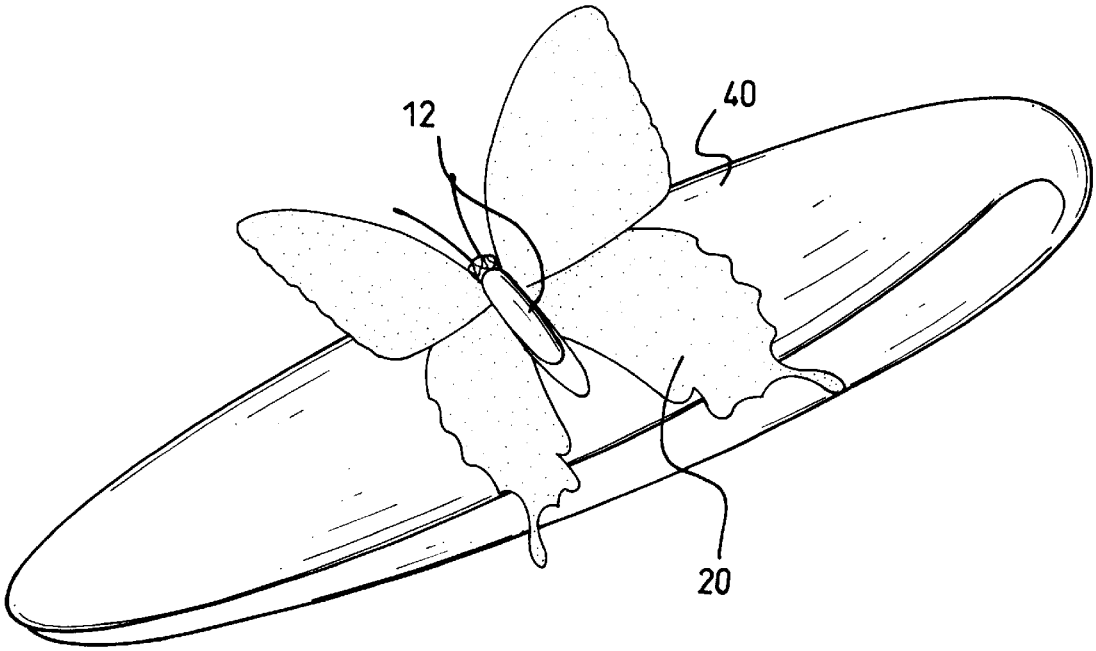
Figure 5:
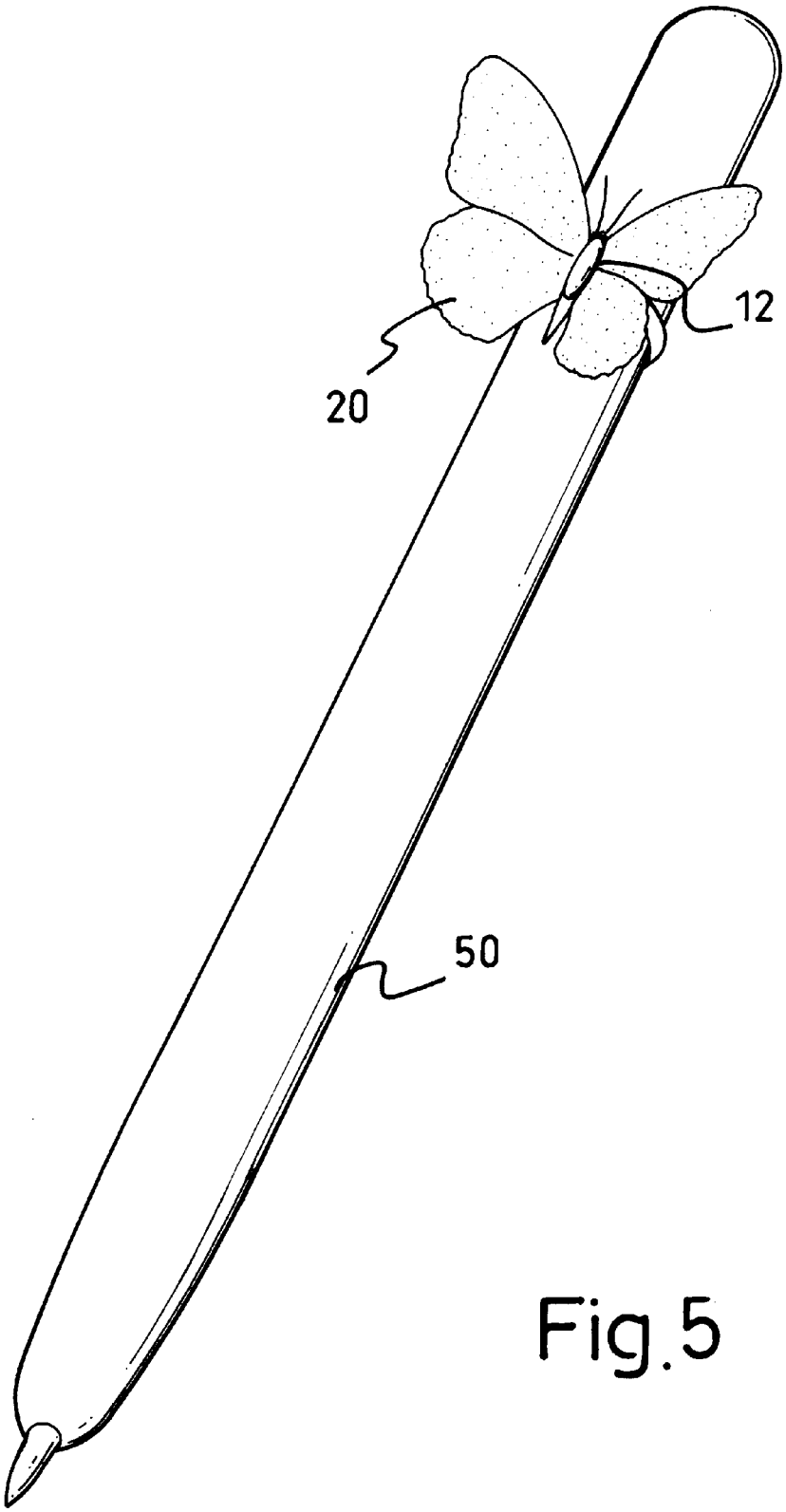
Figure 6:
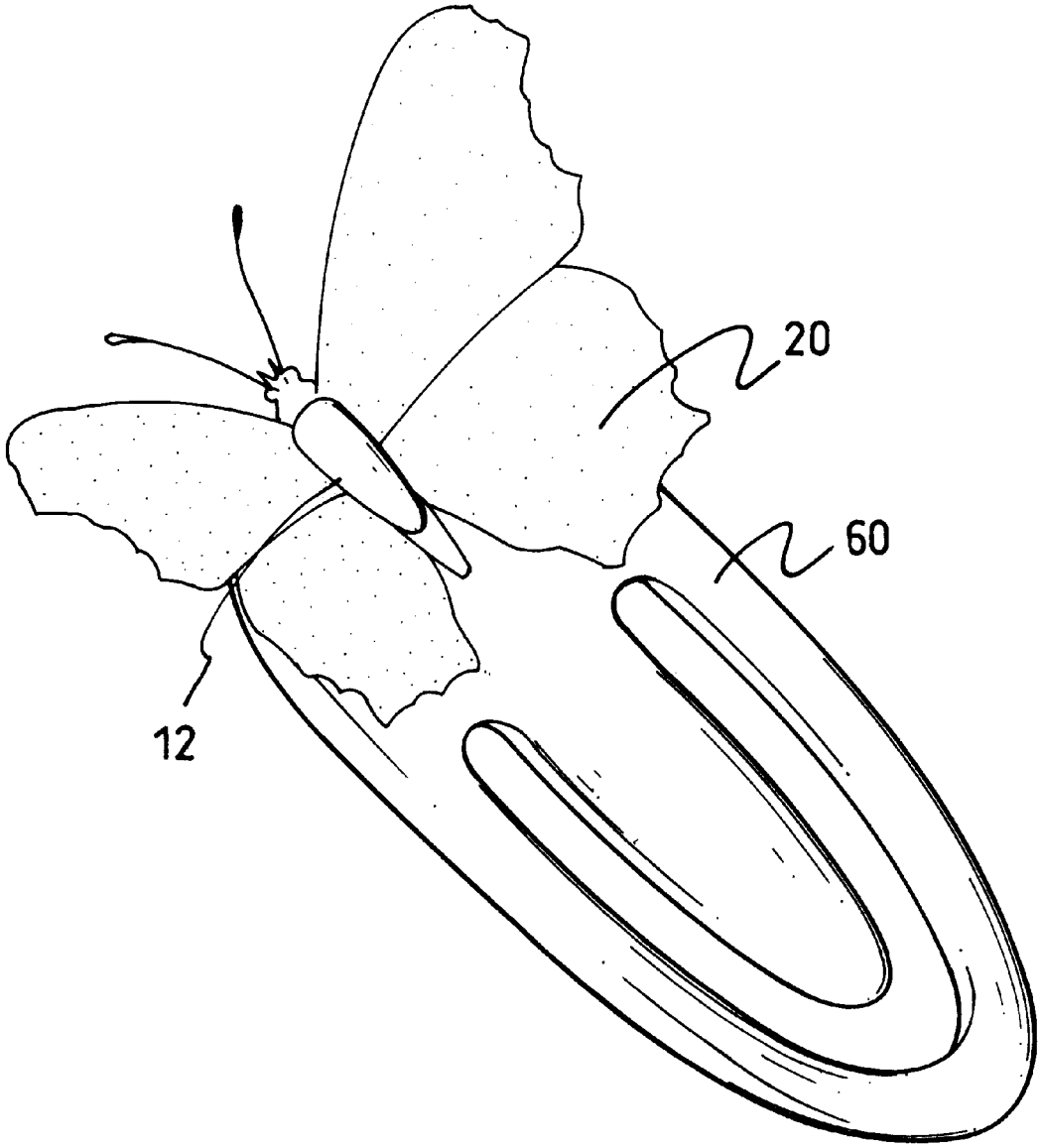

Referring to FIG. 2, when in assembly of the base (10) and the adornment (20), the through hole (22) of the adornment (20) is deformed by the insertion of the elongate bar (12) and after the elongate bar (12) is inserted through the through hole (22), the recovery of the deformed through hole (22) will securely hold the neck (14). Meanwhile, when the elongate bar (12) is inserted through the through hole (22) of the adornment (20), the protrusion (140) is received in the slit (24) has a press fit connection therewith. After the connection between the elongate bar (12) and the adornment (20), the adornment (20) is able to be securely mounted on the base (10). It is to be noted from the drawings that after the elongate bar (12) is inserted through the through hole (22), the elongate bar (12) can be treated as the body of the adornment (20). For example, if the adornment (20) is configured to be a butterfly, the elongate bar (12) is the body of the butterfly.

Referring to FIGS. 3 to 6, it is noted that the base (10) can be a part of a ring (30), a hairwear (40), a pen (50) or even a paper clip (60), etc.

Figure 7:
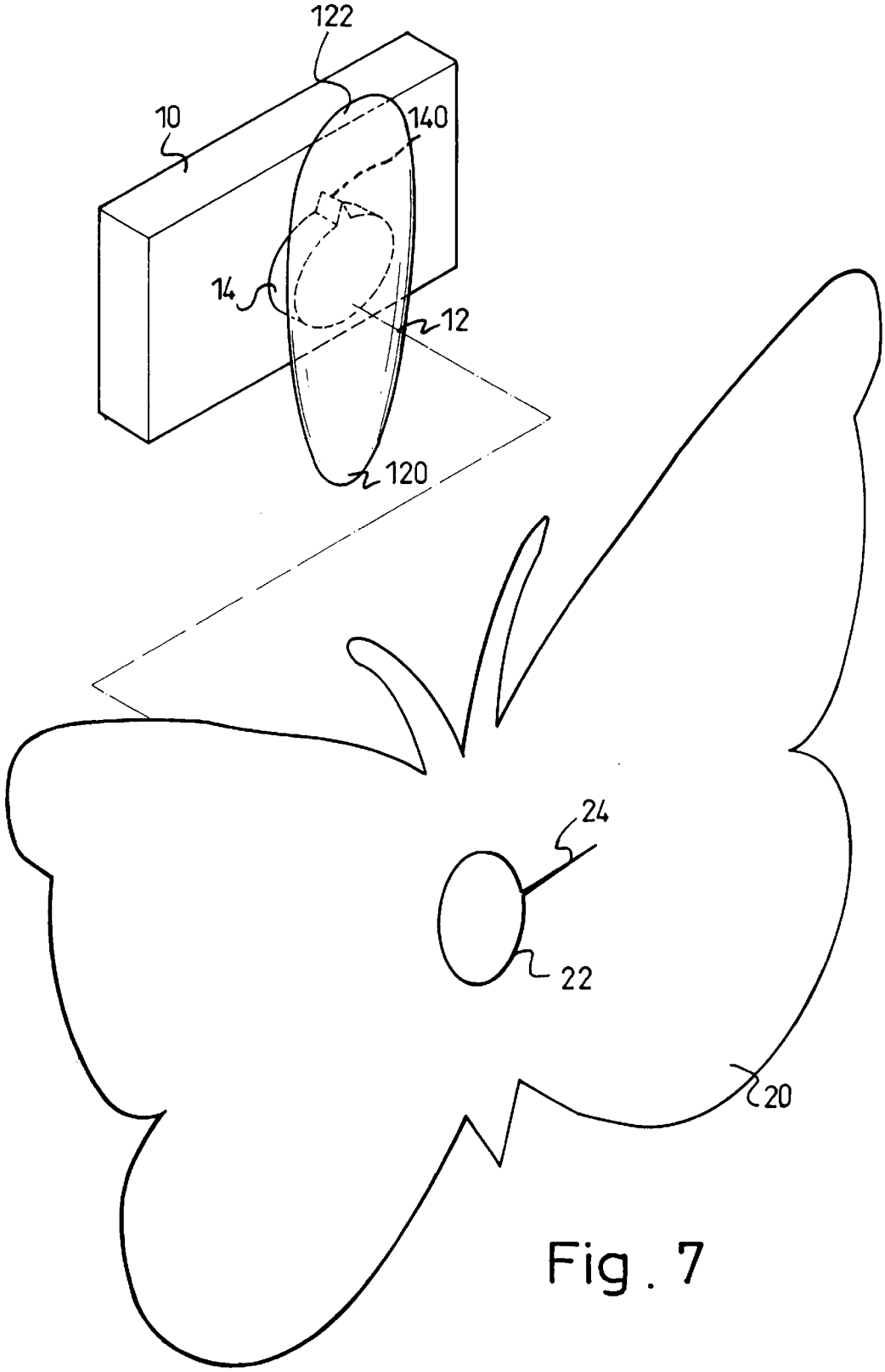
FIG. 7 is an exploded view showing alternative embodiment in accordance with the present invention.
Figure 8:
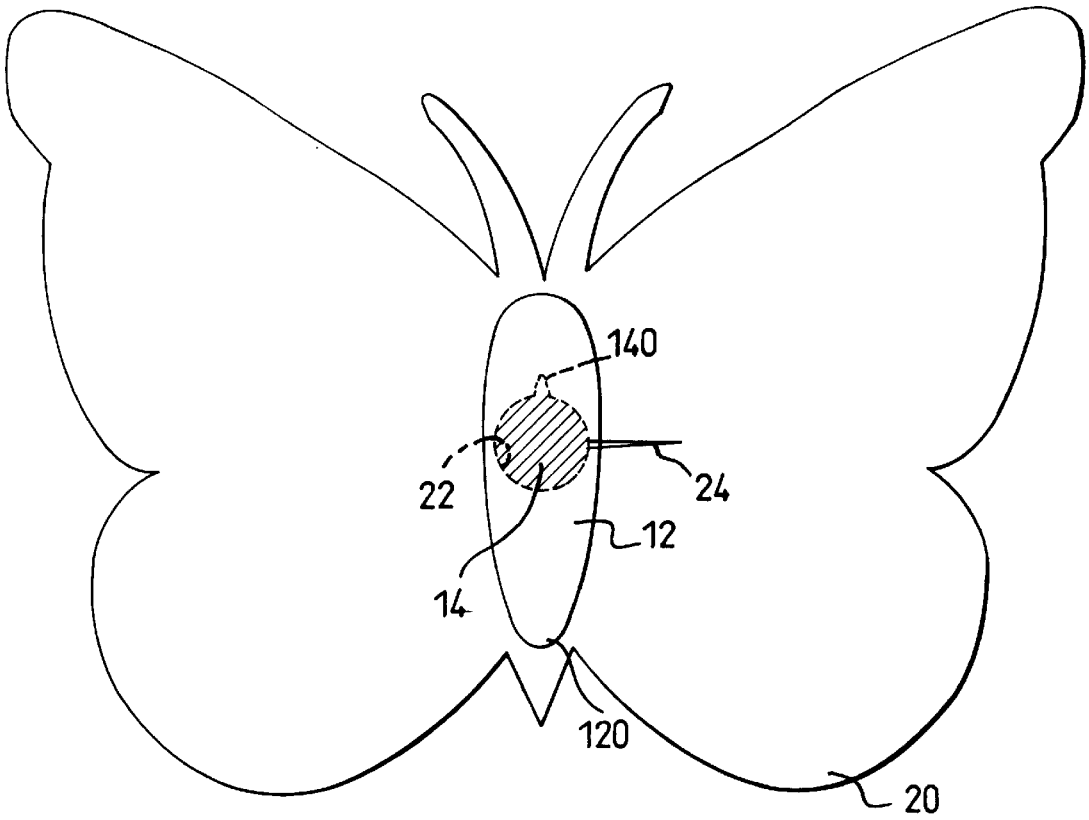
FIG. 8 is a plan view showing that the adornment is attached to a base of an item.

Referring to FIG. 7 and FIG. 8, an alternative embodiment of the invention is shown. The basic structures of the adornment (20) and the base (10) are almost the same as the ones described before. However, the only difference exists that the slit (24) in FIGS. 1 and 2 is defined to have the same orientation with the protrusion (140) of the neck (14) and the slit (24) defined in FIGS. 7 and 8 is defined to have an orientation different from that of the protrusion (140). Because of the orientation difference between the slit (24) and the protrusion (140), the assembly between the adornment (20) and the base (10) requires the user to rotate the adornment (20) to the left or to the right for a certain degree to secure the adornment (20) to the base (10) after the elongate bar (12) extends through the through hole (22) of the adornment (20).

It is to be understood, however, even though numerous characteristics and advantageous of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terns in which the appended claims are expressed.

What is claimed is:

1. An adornment clamping device comprising:

a base having an elongate bar and a neck integrally formed between the base and the elongate bar and having a protrusion formed therewith;

an adornment having a through hole defined to receive the elongate bar therethrough so as to have a press fit therewith, and a slit defined to communicate with the through hole and oriented differently from that of the protrusion of the neck.

2. The adornment clamping device as claimed in claim 1, wherein the slit is tapered.

3. The adornment clamping device as claimed in claim 2, wherein the protrusion is tapered to correspond to the slit.

4. The adornment clamping device as claimed in claim 1, wherein the protrusion is tapered to correspond to the slit.

5. An adornment clamping device comprising:

a base having an elongate bar and a neck integrally formed between the base and the bar;

an adornment having a through hole defined to receive said bar and a slit defined to communicate with the through hole, said neck having a protrusion formed to have an orientation the same as that of the slit.

* * * * *